US008556309B1

(12) United States Patent
Charette

(10) Patent No.: US 8,556,309 B1
(45) Date of Patent: Oct. 15, 2013

(54) MULTI-FUNCTION TRASH PICKING DEVICE

(75) Inventor: Ernest Charette, Sarnia (CA)

(73) Assignee: Leivaire (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 13/584,452

(22) Filed: Aug. 13, 2012

(30) Foreign Application Priority Data

Apr. 13, 2012 (CN) ..... 2012 2 0156199 U

(51) Int. Cl.
*E01H 1/12* (2006.01)
*A01K 29/00* (2006.01)

(52) U.S. Cl.
USPC ..... 294/1.4; 294/104

(58) Field of Classification Search
USPC ..... 294/1.3, 1.4, 1.5, 16, 209, 210, 211, 294/103.1, 104; 15/257.1, 257.6
See application file for complete search history.

(56) References Cited

U.S. PATENT DOCUMENTS

| | | | | |
|---|---|---|---|---|
| 3,328,066 | A * | 6/1967 | Johnston | 294/115 |
| 5,203,598 | A * | 4/1993 | Lindlbauer | 294/1.4 |
| 7,325,849 | B2 * | 2/2008 | Jones | 294/1.4 |
| 7,744,136 | B2 * | 6/2010 | Waltz | 294/1.4 |

* cited by examiner

*Primary Examiner* — Paul T Chin
(74) *Attorney, Agent, or Firm* — Muncy, Geissler, Olds & Lowe, PLLC

(57) ABSTRACT

A multi-function trash picking device includes a foldable rod, a detachable head portion and a handle. The foldable rod includes two elongate rod arms which are connected through a pivot. The two rod arms are folded and unfolded through the pivot. One rod arm has one end connected to the head portion, and the other rod arm has one end connected to the handle. The handle includes a trigger thereon. The head portion includes a clamp and a metallic slide member adapted to open or close the clamp. Two sides of the clamp are respectively provided with two plastic rings adapted to fasten a trash bag. The multi-function trash picking device of the present invention can pick up the excrement of pets or trash easily. The user can hold the pet while picking up the excrement or trash, so that the pet won't be lost.

8 Claims, 5 Drawing Sheets

MULTI-FUNCTION TRASH PICKING DEVICE

BACKGROUND OF THE INVENTION

1. Field of the Invention

The present invention relates to a multi-function trash picking device, and more particularly, to a multi-function trash picking device to pick up the excrement of pets or trash with ease.

2. Description of the Prior Art

The standard of living gradually enhances and raising a pet becomes more and more popular. However, the surrounding becomes worse due to the pet excrements. In order to improve the surrounding, many pet appliances are developed, such as a pet excrement picking device. The configuration of the conventional pet excrement picking device is simple and it is not convenient to clean the picking device. Accordingly, the present invention intends to provide a multi-function trash picking device for improving the shortcomings mentioned above.

SUMMARY OF THE INVENTION

The primary object of the present invention is to provide a multi-function trash picking device which can be used to pick up the excrement of pets or trash easily. Selectively, the present invention can cooperate with a dog leash accessory and a dog walking accessory to hold the pet when the user picks up trash.

The multi-function trash picking device of the present invention comprises a foldable rod, a detachable head portion and a handle. The foldable rod comprises two elongate rod arms which are connected through a pivot. The two rod arms are folded and unfolded through the pivot. One rod arm has one end connected to the head portion, and the other rod arm has one end connected to the handle. The handle comprises a trigger thereon. The head portion comprises a clamp and a metallic slide member adapted to open or close the clamp. Two sides of the clamp are respectively provided with two plastic rings adapted to fasten a trash bag.

Preferably, the two rod arms comprise a wire rope therein. One end of the wire rope is connected to the metallic slide member, and the other end of the wire rope is connected to the trigger of the handle.

Preferably, the head portion has a chamber adapted to store trash bags.

Preferably, the multi-function trash picking device further comprises a lock buckle to lock the rod arms when the rod arms are folded.

Preferably, the rod arms have a positioning hole and a positioning member at inner ends thereof for engagement when the rod arms are unfolded.

Preferably, the multi-function trash picking device further comprises a dog leash accessory. The lower end of the dog leash accessory is coupled to the head portion, and the upper end of the dog leash accessory is adapted for connection of a dog leash.

Preferably, the multi-function trash picking device further comprises a dog walking accessory. The lower end of the dog walking accessory is coupled to the head portion and an upper end of the dog walking accessory is adapted for connection of a traditional device to walk a dog.

Preferably, the head portion further comprises a pin-type lock to lock the clamp.

Preferably, the rod arms further comprises a hook and a slide-type lock to slide along the rod arms. The slide-type lock cooperates with the hook to lock the head portion.

Compared to the prior art, the multi-function trash picking device of the present invention can pick up the excrement of pets or trash easily. Selectively, the present invention can cooperate with the dog leash accessory and the dog walking accessory to hold the pet when the user picks up trash.

DETAILED DESCRIPTION OF THE PREFERRED EMBODIMENTS

Embodiments of the present invention will now be described, by way of example is only, with reference to the accompanying drawings.

Figure 1:
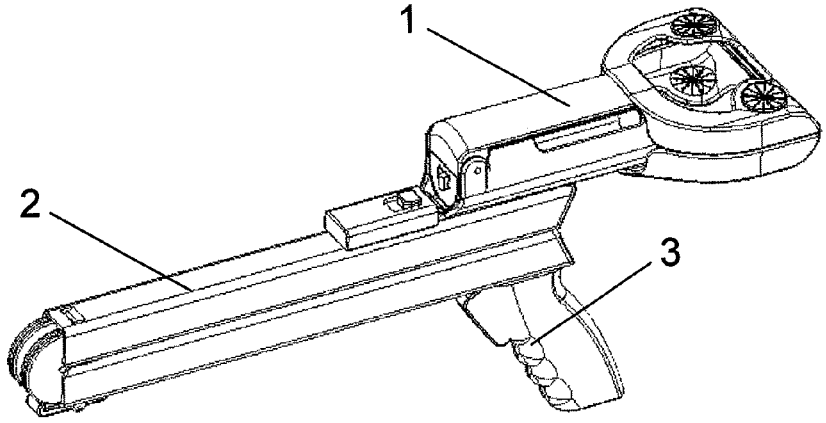
FIG. 1 is a perspective view according to a preferred embodiment of the present invention.
Figure 2:
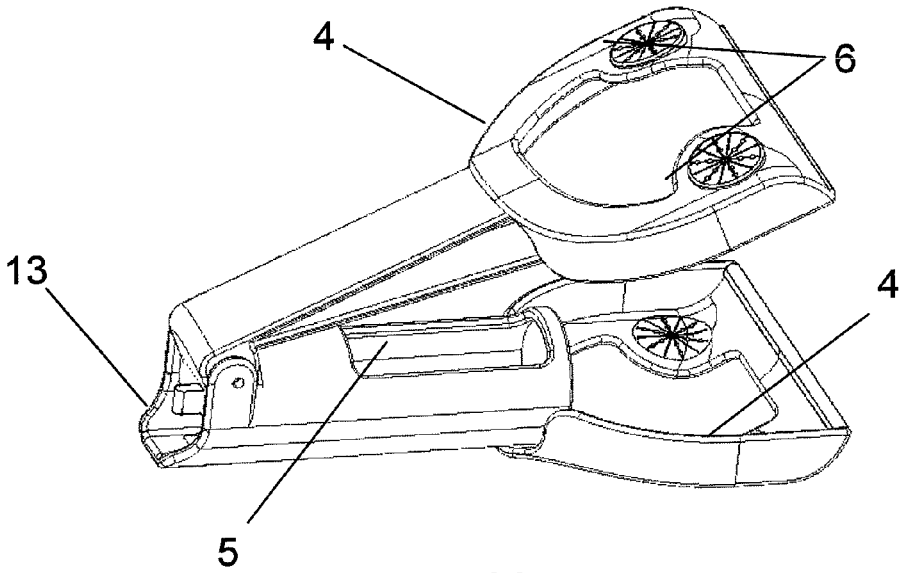
FIG. 2 is a perspective view showing the head portion according to the preferred embodiment of the present invention.
Figure 3:
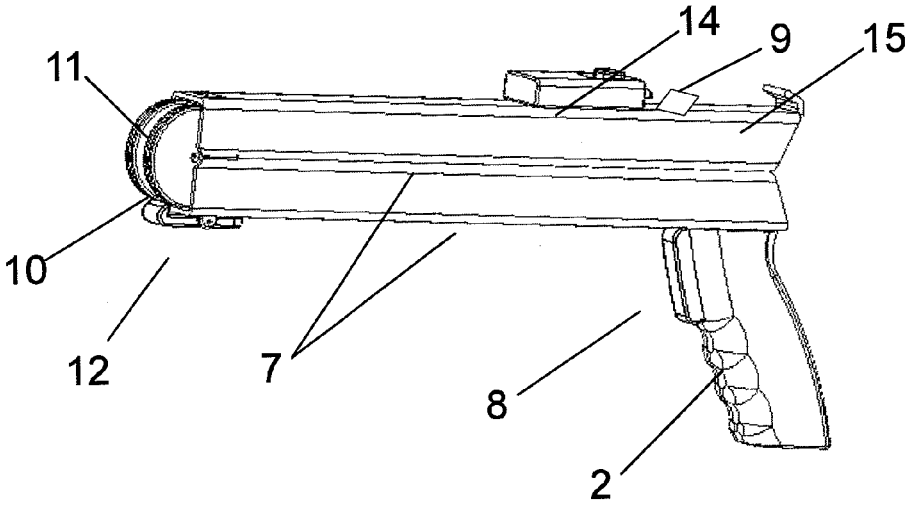
FIG. 3 is a perspective view showing the foldable rod and the handle according to the preferred embodiment of the present invention.
Figure 4:
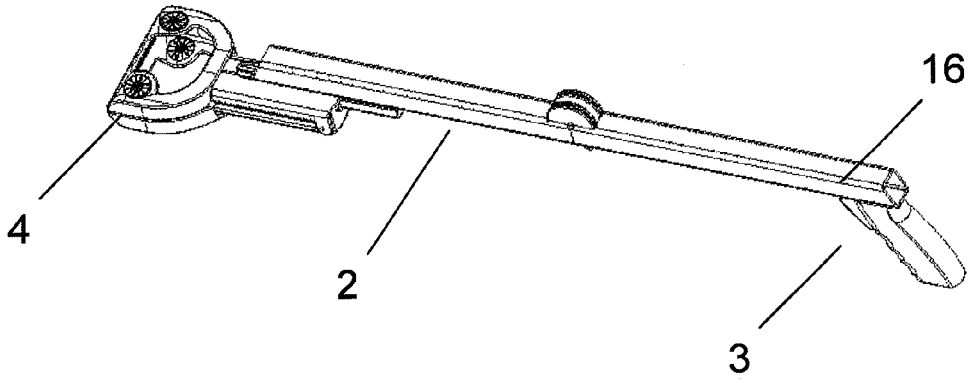
FIG. 4 is a perspective view of the preferred embodiment of the present invention in an unfolded state.
Figure 5:
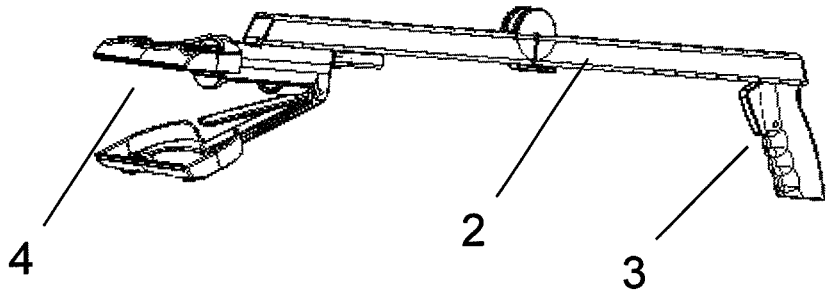
FIG. 5 is a perspective view of the preferred embodiment of the present invention when in use.
Figure 6:
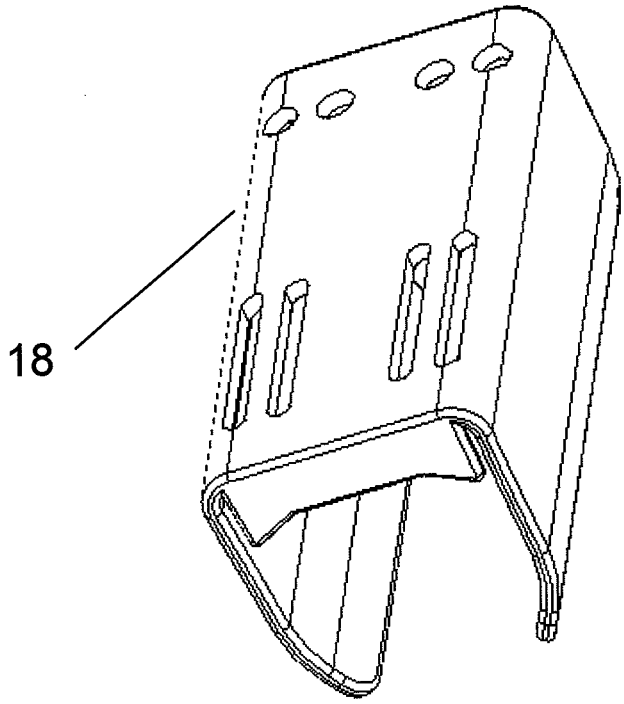
FIG. 6 is a perspective view showing the dog walking accessory according to the preferred embodiment of the present invention.
Figure 7:
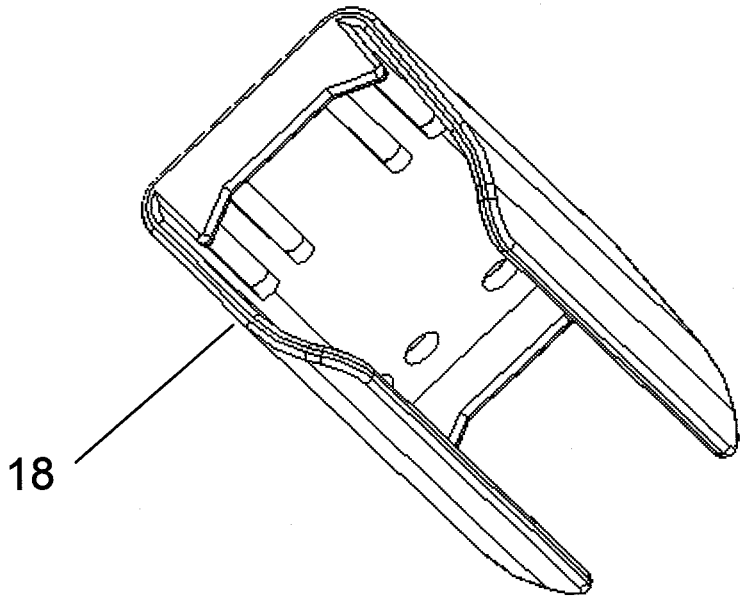
FIG. 7 is another perspective view showing the dog walking accessory according to the preferred embodiment of the present invention.
Figure 8:
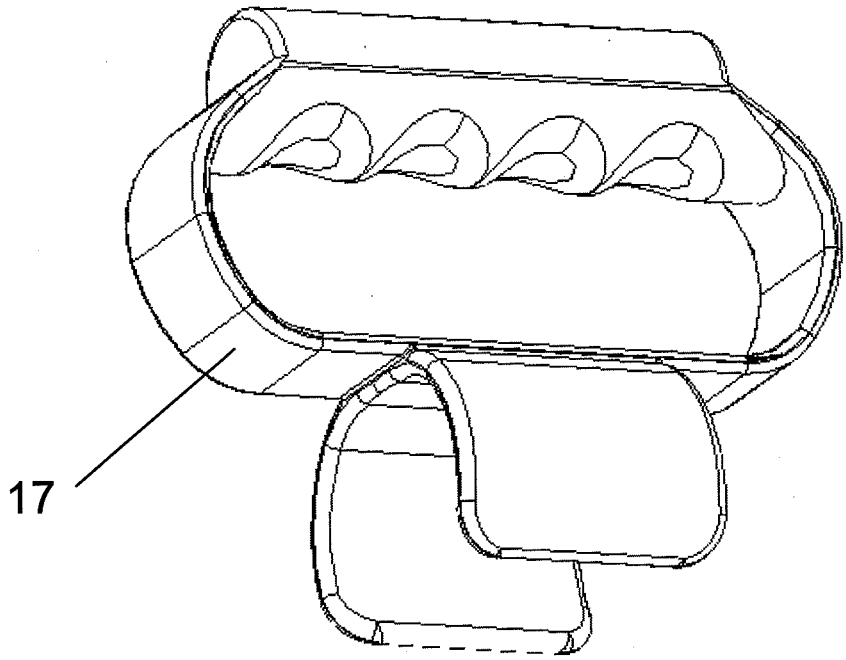
FIG. 8 is a perspective view showing the dog leash accessory according to the preferred embodiment of the present invention.
Figure 9:
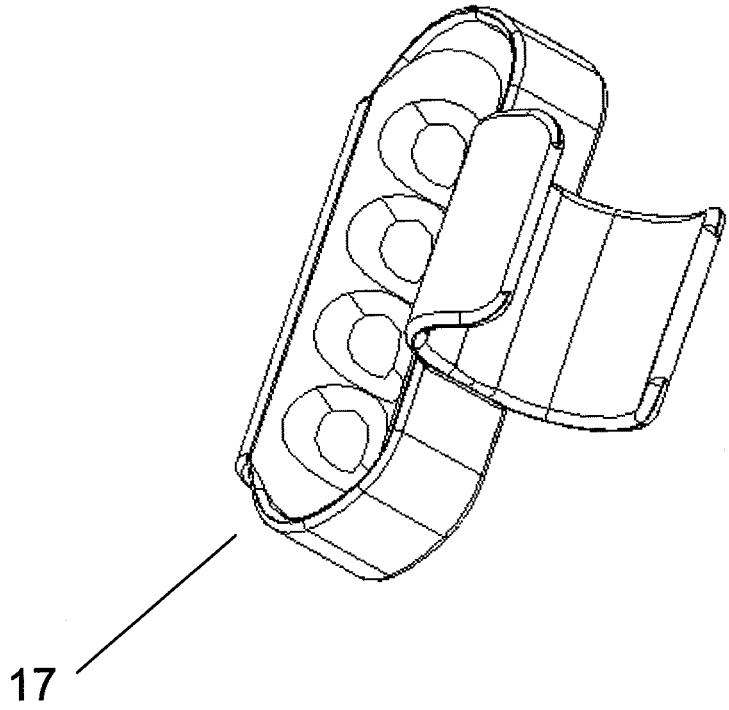
FIG. 9 is another perspective view showing the dog leash accessory according to the preferred embodiment of the present invention.

As shown in FIG. 1 through FIG. 5, the multi-function trash picking device according to a preferred embodiment of the present invention comprises a foldable rod 2, a detachable head portion 1, and a handle 3. The foldable rod 2 comprises two elongate rod arms 7 which are connected through a pivot 10. The two rod arms 7 can be folded and unfolded through the pivot 10. One rod arm 7 has one end connected to the head portion 1, and the other rod arm 7 has one end connected to the handle 1. The handle 3 comprises a trigger 8 thereon. The head portion 1 comprises a clamp 4 and a metallic slide member 9 used to open or close the clamp 4. Two sides of the clamp 4 are respectively provided with two plastic rings 6 used to fasten a trash bag. The two rod arms 7 comprise a wire rope therein. One end of the wire rope is connected to the metallic slide member 9, and the other end of the wire rope is connected to the trigger 8 of the handle 3.

The head portion 1 has a chamber 5 used to store trash bags. The present invention further comprises a lock buckle 16 to lock the rod arms 7 when the rod arms 7 are folded. The rod arms 7 have a positioning hole 11 and a positioning member 12 at inner ends thereof for engagement when the rod arms 7 are unfolded. The present invention further comprises a dog leash accessory 17. The lower end of the dog leash accessory 17 is coupled to the head portion 1, and the upper end of the dog leash accessory 17 is adapted for connection of a dog leash. The present invention further comprises a dog walking accessory 18 for walking a dog. The lower end of the dog walking accessory 18 is coupled to the head portion 1, and the upper end of the dog walking accessory 18 is adapted for connection of a traditional device to walk a dog. The head portion 1 further comprises a pin-type lock 13 to lock the clamp 4. The rod arms 7 further comprises a hook 15 and a slide-type lock 14 to slide along the rod arms 7. The slide-type lock 14 cooperates with the hook 15 to lock the head portion 1.

When in use, as shown in FIG. 1 through FIG. 5, the multi-function trash picking device of the present invention comprises the foldable rod 2, the detachable head portion 1, the handle 3, and the two accessories. The head portion 1 comprises the clamp 4 and the chamber 5. Two sides of the head portion 1 are respectively provided with the two plastic rings 6 to fasten the edge of a trash bag.

The chamber 5 is to store trash bags. The foldable rod 2 has the two elongate rod arms 7 which can be folded or unfolded through a buckle. When the rod arms 7 are folded, the buckle is used to lock the rod arms 7.

The handle 3 is connected with the distal end of one rod arm 7, conforming to ergonomics. The trigger 8 is connected with one end of the wire rope in the rod arms. The other end of the wire rope is connected with the metallic slide member 9 of the head portion 1. Through the trigger 8, the clamp 4 of the head portion 1 is controlled to open or close.

The two accessories, one is the dog leash accessory 17 for walking a dog. The lower end of the dog leash accessory 17 is coupled to the head portion 1, and the upper end of the dog leash accessory 17 is adapted for connection of a rope. The other is the dog walking accessory 18. The lower end of the dog walking accessory 18 is coupled to the head portion 1, and the upper end of the dog walking accessory 18 is adapted for connection of a traditional walking device through an adhesive strip or a plastic rope.

The present invention can pick up and collect the excrement of pets with ease. To practice the present invention, a trash bag is fitted on the head portion 1 and the edge of the trash bag is fastened by the plastic rings 6. The front end of the head portion 1 points at the excrement or trash. The user operates the trigger 8 to control the head portion 1 to pick up the excrement or trash to be collected in the trash bag.

Another use way of the present invention is that the user can hold the picking device with one end and a trash bag with the other end to pick up the excrement or trash easily without bending down.

The head portion 1 of the picking device is detachable. When the head portion 1 is used only, the user can use the two accessories, the dog leash accessory and the dog walking accessory, to hold the pet while picking up the excrement, so that the pet won't be lost.

The multi-function trash picking device of the present invention has the following advantages.

1. The head portion has the chamber to store trash bags conveniently.

2. When the trash bag is fitted on the head portion, the four plastic rings are used to secure the trash bag and to take out the trash bag, so that the picking device and the user's hands won't be dirtied.

3. The excrement or trash is collected into the trash bag.

4. The seal design at the side of the head portion can control the excrement or trash not exposed so the odor won't fill the surroundings.

5. The product can be folded for carrying.

6. The head portion is detachable and can be used to cooperate with the dog leash accessory and the dog walking accessory.

7. The lock buckle is used to secure the two rod arms together after the rod arms are folded.

Accordingly, the multi-function trash picking device of the present invention can pick up the excrement of pets or trash easily. Selectively, the present invention can cooperate with the dog leash accessory and the dog walking accessory to hold the pet when the user picks up trash.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A multi-function trash picking device, comprising a foldable rod (2), a detachable head portion (1) and a handle (3);

the foldable rod (2) comprising two elongate rod arms (7) which are connected through a pivot (10), the two rod arms (7) being folded and unfolded through the pivot (10), one rod arm (7) having one end connected to the head portion (1) and the other rod arm (7) having one end connected to the handle (1), the handle (3) comprising a trigger (8) thereon;

the head portion (1) comprising a clamp (4) and a metallic slide member (9) adapted to open or close the clamp (4), two sides of the clamp (4) being respectively provided with two plastic rings (6) adapted to fasten a trash bag;

the two rod arms (7) comprising a wire rope therein, one end of the wire rope being connected to the metallic slide member (9) and another end of the wire rope being connected to the trigger (8) of the handle (3).

2. The multi-function trash picking device as claimed in claim 1, wherein the head portion (1) has a chamber (5) adapted to store trash bags.

3. The multi-function trash picking device as claimed in claim 2, further comprising a lock buckle (16) to lock the rod arms (7) when the rod arms (7) are folded.

4. The multi-function trash picking device as claimed in claim 3, wherein the rod arms (7) have a positioning hole (11) and a positioning member (12) at inner ends thereof for engagement when the rod arms (7) are unfolded.

5. The multi-function trash picking device as claimed in claim 4, further comprising a dog leash accessory (17), a lower end of the dog leash accessory (17) being coupled to the head portion (1) and an upper end of the dog leash accessory (17) being adapted for connection of a dog leash.

6. The multi-function trash picking device as claimed in claim 4, further comprising a dog walking accessory (18), a lower end of the dog walking accessory (18) being coupled to the head portion (1) and an upper end of the dog walking accessory (18) being adapted for connection of a traditional device tb walk a dog.

7. The multi-function trash picking device as claimed in claim 4, wherein the head portion (1) further comprises a pin-type lock (13) to lock the clamp (4).

8. The multi-function trash picking device as claimed in claim 4, wherein the rod arms (7) further comprises a hook (15) and a slide-type lock (14) to slide along the rod arms (7), the slide-type lock (14) cooperating with the hook (15) to lock the head portion (1).

* * * * *